US008659627B2

(12) United States Patent
Mori

(10) Patent No.: US 8,659,627 B2
(45) Date of Patent: Feb. 25, 2014

(54) SELF LIGHT EMITTING DISPLAY DEVICE FOR ADJUSTING A NECESSARY BRIGHTNESS BASED ON USER SETTING, OUTSIDE LIGHT OR VIDEO SIGNAL

(75) Inventor: Hideto Mori, Tokyo (JP)

(73) Assignee: Sony Corporation, Tokyo (JP)

( * ) Notice: Subject to any disclaimer, the term of this patent is extended or adjusted under 35 U.S.C. 154(b) by 446 days.

(21) Appl. No.: 12/796,090

(22) Filed: Jun. 8, 2010

(65) Prior Publication Data

US 2011/0007101 A1 Jan. 13, 2011

(30) Foreign Application Priority Data

Jul. 10, 2009 (JP) ..... 2009-164051

(51) Int. Cl.
*G09G 5/10* (2006.01)

(52) U.S. Cl.
USPC ..... 345/690; 345/77

(58) Field of Classification Search
USPC ..... 345/207, 77, 690
See application file for complete search history.

(56) References Cited

U.S. PATENT DOCUMENTS

| | | | | |
|---|---|---|---|---|
| 7,482,759 | B2 | 1/2009 | Yoneyama et al. | |
| 2007/0002182 | A1* | 1/2007 | Obayashi et al. | 348/675 |
| 2007/0040774 | A1* | 2/2007 | Lee et al. | 345/77 |
| 2008/0204384 | A1 | 8/2008 | Lee et al. | |
| 2008/0204438 | A1 | 8/2008 | Song et al. | |
| 2008/0278421 | A1* | 11/2008 | Inoue et al. | 345/77 |
| 2009/0015601 | A1* | 1/2009 | Kim | 345/690 |

FOREIGN PATENT DOCUMENTS

| | | |
|---|---|---|
| EP | 1 962 267 A1 | 8/2008 |
| EP | 1 962 268 A1 | 8/2008 |
| JP | 2005-208241 | 8/2005 |
| JP | 2008-151946 | 7/2008 |

OTHER PUBLICATIONS

European Search Report issued Oct. 31, 2011 in patent application No. 10168048.6.

* cited by examiner

*Primary Examiner* — Long D Pham
(74) *Attorney, Agent, or Firm* — Oblon, Spivak, McClelland, Maier & Neustadt, L.L.P.

(57) ABSTRACT

A self light emitting display device is provided which includes a panel driver which changes a maximum voltage supplied to the self light emitting display panel according to the necessary maximum brightness, a storage unit which holds data related to a reverse gamma characteristic that is opposite to a gamma characteristic between an amount of light emitted from the self light emitting display panel and a voltage supplied from the panel driver to the self light emitting display panel, and a panel gamma generation unit which generates an output signal based on the reverse gamma characteristic by changing an applicable range of the reverse gamma characteristic according to the necessary maximum brightness while maintaining the same gradations as those when the self light emitting display panel emits light at a displayable maximum brightness. The panel driver drives the self light emitting display panel based on the output signal.

9 Claims, 13 Drawing Sheets

FIG.7

| INPUT | OUTPUT |
|---|---|
| 0 | 0 |
| 1 | 0.2 |
| ⋮ | ⋮ |
| 255 ($A_{MA}$) | 1 ($V_{BMA}$) |

FIG.9A

| INPUT | OUTPUT |
|---|---|
| 0 | 0 |
| 1 | 0.2 |
| ⋮ | ⋮ |
| $A_1$ | $V_{B1}$ |
| ⋮ | ⋮ |
| 255 ($A_{MA}$) | 1 ($V_{BMA}$) |

⇒

FIG.9B

| INPUT | OUTPUT |
|---|---|
| 0 | 0 |
| $1\times\frac{255}{A_1}$ | 0.2 |
| ⋮ | ⋮ |
| 255 ($A_1$) | $V_{B1}$ |

⇒

FIG.9C

| INPUT | OUTPUT |
|---|---|
| 0 | $0\times\frac{1}{V_{B1}}=0$ |
| $1\times\frac{255}{A_1}$ | $0.2\times\frac{1}{V_{B1}}=\frac{0.2}{V_{B1}}$ |
| ⋮ | ⋮ |
| 255 ($A_1$) | $V_{B1}\times\frac{1}{V_{B1}}=1$ |

SELF LIGHT EMITTING DISPLAY DEVICE FOR ADJUSTING A NECESSARY BRIGHTNESS BASED ON USER SETTING, OUTSIDE LIGHT OR VIDEO SIGNAL

BACKGROUND OF THE INVENTION

1. Field of the Invention

The present invention relates to a self light emitting display device and a method for driving self light emitting display device.

2. Description of the Related Art

When a display (display device) is used as a home display, the brightness of a screen displayed by the device is set high according to the home use environment. On the other hand, the brightness of the screen of a studio video monitor, a master monitor, a photograph monitor for checking photographs, and the like is set low because reproduction quality is more important than the brightness of a video image.

When a method in which an image is displayed while the brightness of the screen is set low in a self light emitting display such as an organic EL display is tried to be realized in a home display, a reference brightness of the device is set high, and a certain gain is set on a video signal in a dark environment to realize the method. For example, when the brightness can be one-half of a maximum brightness corresponding to a maximum input "1", the gain is set to "0.5". However, in this case, a color resolution of the input signal decreases to one-half.

[Patent Document 1] Japanese Patent Application Laid-Open No. 2005-208241

[Patent Document 2] Japanese Patent Application Laid-Open No. 2008-151946

SUMMARY OF THE INVENTION

In a liquid crystal display, only a backlight is controlled to control the brightness, and gain need not be applied to the input signal. However, in a self light emitting display device such as an organic EL display, a gain needs to be applied to the input signal so as to change the brightness of the screen. As a result, there is an issue that applying a gain to the input signal decreases a color resolution of a video image.

Japanese Unexamined Patent Application Publication No. 2005-208241 discloses that only the brightness can be controlled without decreasing bit depth by independently controlling R, G and B. However, in the technique of Japanese Unexamined Patent Application Publication No. 2005-208241, an issue occurs in intermediate gradation expression capability in a device having a gamma unique to the display.

In light of the foregoing, it is desirable to provide a novel and improved self light emitting display device and a method for driving self light emitting display device capable of controlling brightness without decreasing color resolution (bit depth) of a video signal, and further without deteriorating color.

According to an embodiment of the present invention, there is provided a self light emitting display device including an active matrix drive type self light emitting display panel, a necessary brightness calculation unit which calculates a necessary maximum brightness that is necessary for light emission of the self light emitting display panel based on a user setting, a circumference environment, or a video signal, a panel driver which drives the self light emitting display panel by changing a maximum voltage supplied to the self light emitting display panel according to the necessary maximum brightness, a storage unit which holds data related to a reverse gamma characteristic that is opposite to a gamma characteristic between an amount of light emitted from the self light emitting display panel and a voltage supplied from the panel driver to the self light emitting display panel, and a panel gamma generation unit which generates an output signal to the panel driver based on the reverse gamma characteristic by changing an applicable range of the reverse gamma characteristic according to the necessary maximum brightness while maintaining the same gradations as those when the self light emitting display panel emits light at a displayable maximum brightness. The panel driver drives the self light emitting display panel based on the output signal.

In the panel gamma generation unit, the number of gradations of a signal input in the applicable range of the reverse gamma characteristic may be the same as those when the self light emitting display panel emits light at a displayable maximum brightness regardless of a value of the necessary maximum brightness.

The applicable range of the reverse gamma characteristic which is changed according to the necessary maximum brightness may be determined based on the maximum voltage.

According to an embodiment of the present invention, there is provided a method for driving a self light emitting display device, the method including the steps of calculating a necessary maximum brightness that is necessary for light emission of an active matrix drive type self light emitting display panel based on a user setting, a circumference environment, or a video signal, by a necessary brightness calculation unit, driving the self light emitting display panel by changing a maximum voltage supplied to the self light emitting display panel according to the necessary maximum brightness, by a panel driver, holding data related to a reverse gamma characteristic that is opposite to a gamma characteristic between an amount of light emitted from the self light emitting display panel and a voltage supplied from the panel driver to the self light emitting display panel, by a storage unit, generating an output signal to the panel driver based on the reverse gamma characteristic by changing an applicable range of the reverse gamma characteristic according to the necessary maximum brightness while maintaining the same gradations as those when the self light emitting display panel emits light at a displayable maximum brightness, by a panel gamma generation unit, and driving the self light emitting display panel based on the output signal, by the panel driver.

According to an embodiment of the present invention, it is possible to control brightness without decreasing color resolution (bit depth) of a video signal, and further without deteriorating color.

BRIEF DESCRIPTION OF THE DRAWINGS

FIG. 7 is an explanatory diagram illustrating a look-up table (LUT) of data having a characteristic opposite to a gamma characteristic of the OLED panel 120;

FIG. 9 is an explanatory diagram illustrating a look-up table (LUT) of data having a characteristic opposite to a gamma characteristic of the OLED panel 120;

DETAILED DESCRIPTION OF THE EMBODIMENT

Figure 1:
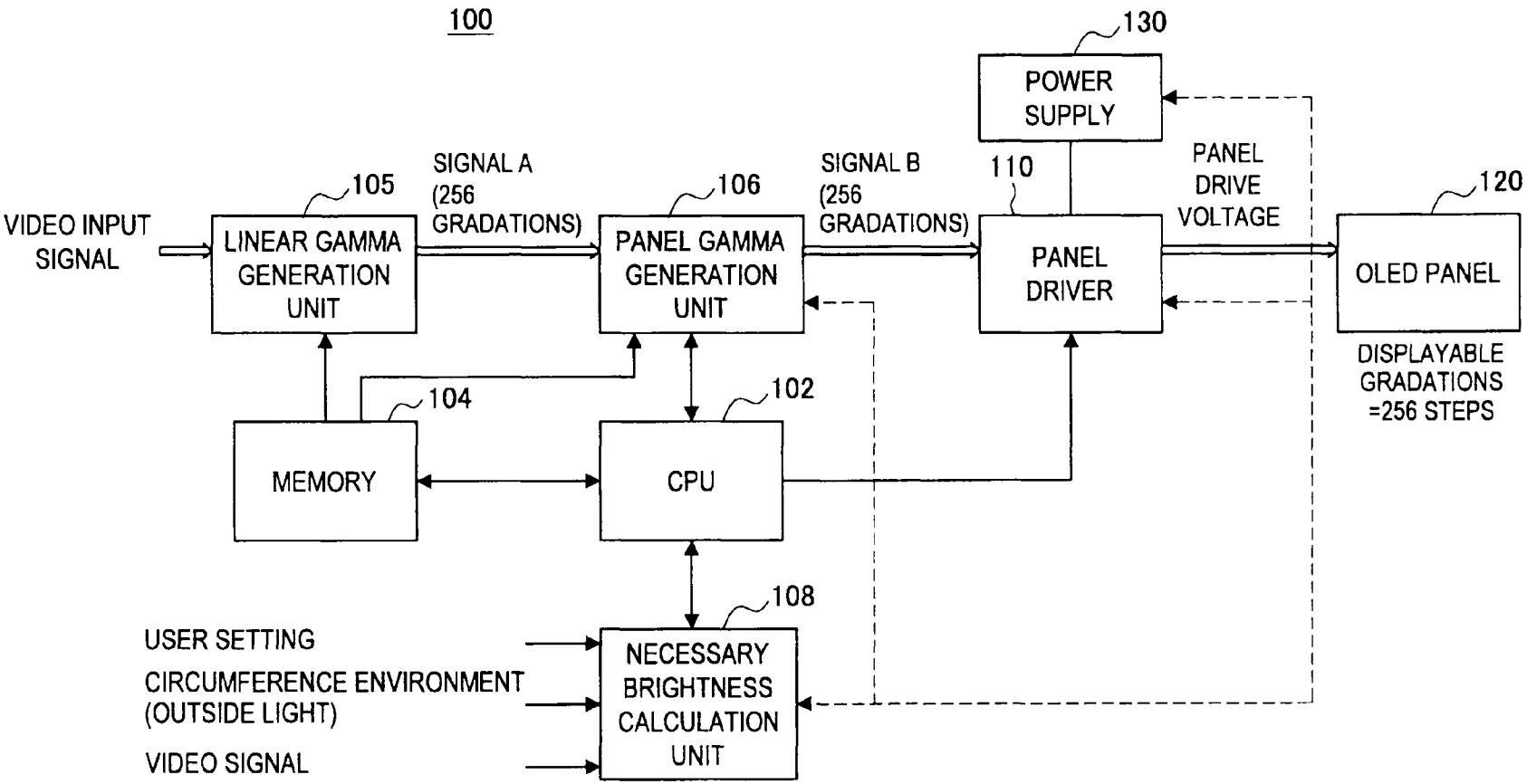
FIG. 1 is a block diagram showing an organic EL display device 100 according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

1. Configuration of First Embodiment
2. Operation of First Embodiment

<1. Configuration of First Embodiment>

First, a configuration of an organic EL display device 100 according to a first embodiment of the present invention will be described with reference to FIG. 1. FIG. 1 is a block diagram showing an organic EL display device 100 according to the embodiment.

As shown in FIG. 1, the organic EL display device 100 includes a CPU 102, a memory 104, a linear gamma generation unit 105, a panel gamma generation unit 106, a necessary brightness calculation unit 108, a panel driver 110, and an OLED panel 120. A video input signal is input into the organic EL display device 100, and the organic EL display device 100 displays a video image on the OLED panel 120 based on the video input signal.

The CPU 102 controls each functional block included in the organic EL display device 100. The memory 104 holds, for example, brightness information related to a displayable maximum brightness that can be represented by the organic EL display device 100.

The video input signal is input into the linear gamma generation unit 105, and the linear gamma generation unit 105 converts the video input signal and outputs a signal A.

Figure 2:
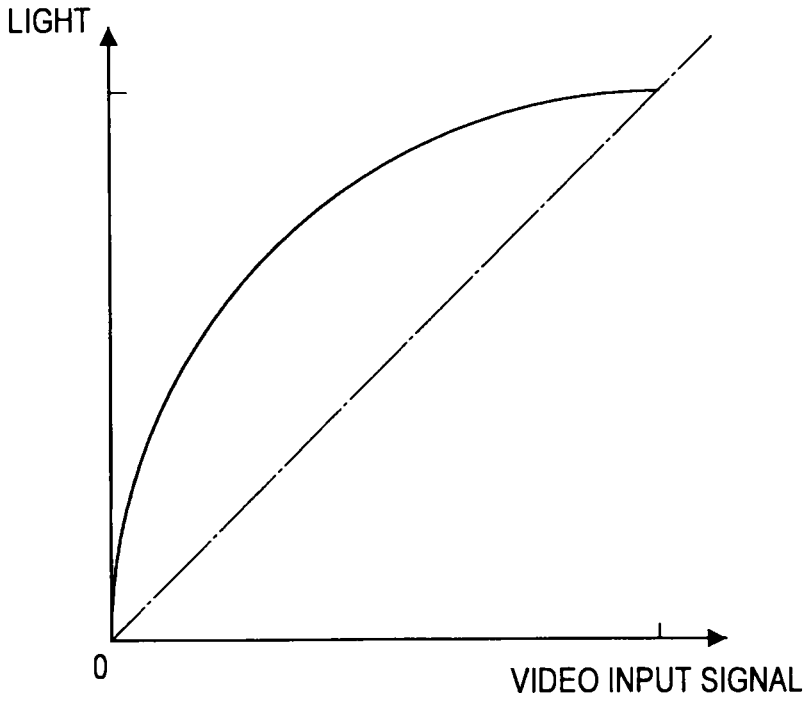
FIG. 2 is a graph showing a relationship between strength of light and a video input signal input into the organic EL display device 100.

The strength of light and the video input signal input into the organic EL display device 100 have a gamma characteristic relationship as shown in FIG. 2. FIG. 2 is a graph showing the relationship between the strength of light and the video input signal input into the organic EL display device 100.

The memory 104 holds data having a characteristic opposite to the gamma characteristic of the relationship between the video input signal input into the organic EL display device 100 and the strength of light, for example, as a look-up table (LUT). The amount of data in the look-up table held by the memory 104 can be arbitrarily determined according to a curve characteristic or the like.

Figure 3:
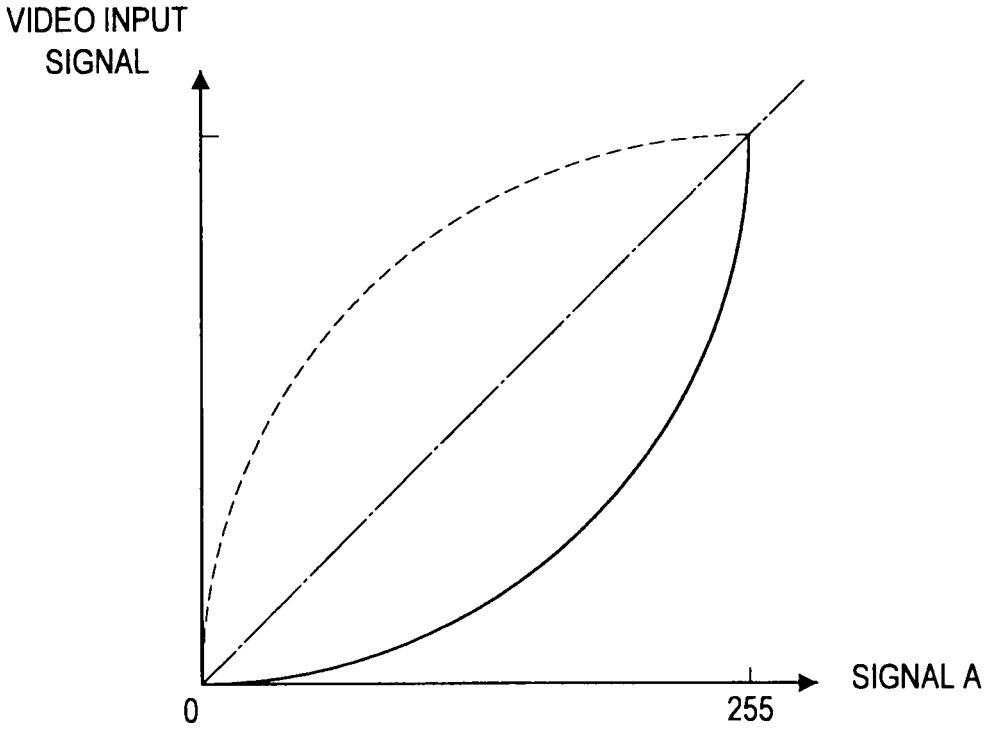
FIG. 3 is a graph showing a relationship between the video input signal and a signal A.

The linear gamma generation unit 105 reads the LUT and performs interpolation processing to generate curve data as shown in FIG. 3 having a characteristic opposite to the gamma characteristic of the relationship between the video input signal input into the organic EL display device 100 and the strength of light. FIG. 3 is a graph showing a relationship between the video input signal and the signal A.

Figure 4:
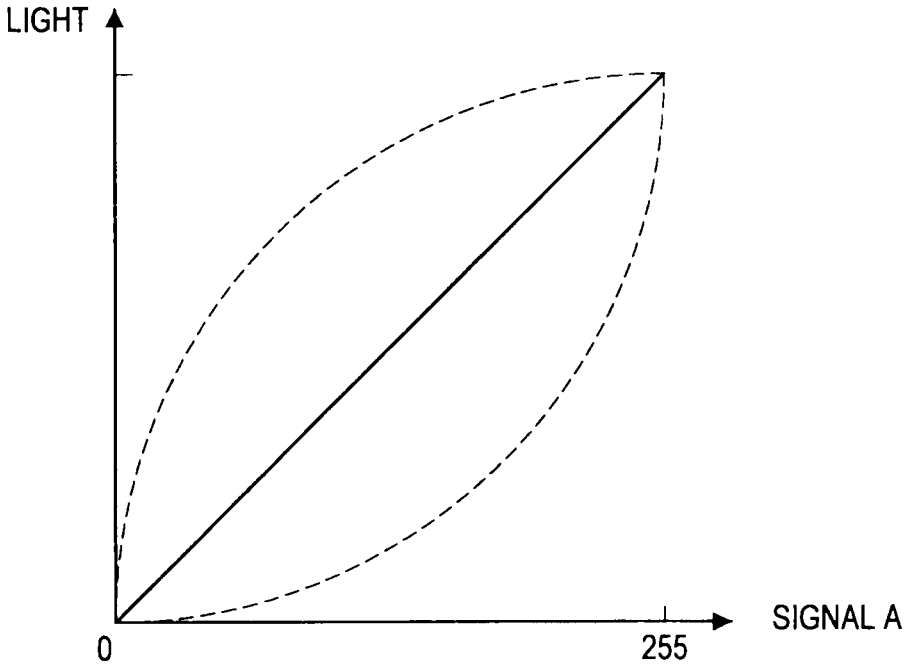
FIG. 4 is a graph showing a relationship between the strength of light and the signal A input into a panel gamma generation unit 106.

The linear gamma generation unit 105 converts the video input signal by using the curve data shown in FIG. 3, and outputs the signal A. Based on this, the strength of light and the signal A have a linear relationship as shown in FIG. 4. FIG. 4 is a graph showing the relationship between the strength of light and the signal A input into the panel gamma generation unit 106. The signal A output from the linear gamma generation unit 105 is input into the panel gamma generation unit 106.

The panel gamma generation unit 106 converts the signal A and outputs a signal B related to a value of panel drive voltage.

The memory 104 is an example of a storage unit, and holds data having the characteristic opposite to the gamma characteristic (reverse gamma characteristic) of the OLED panel 120 as a look-up table (LUT).

Figure 5:
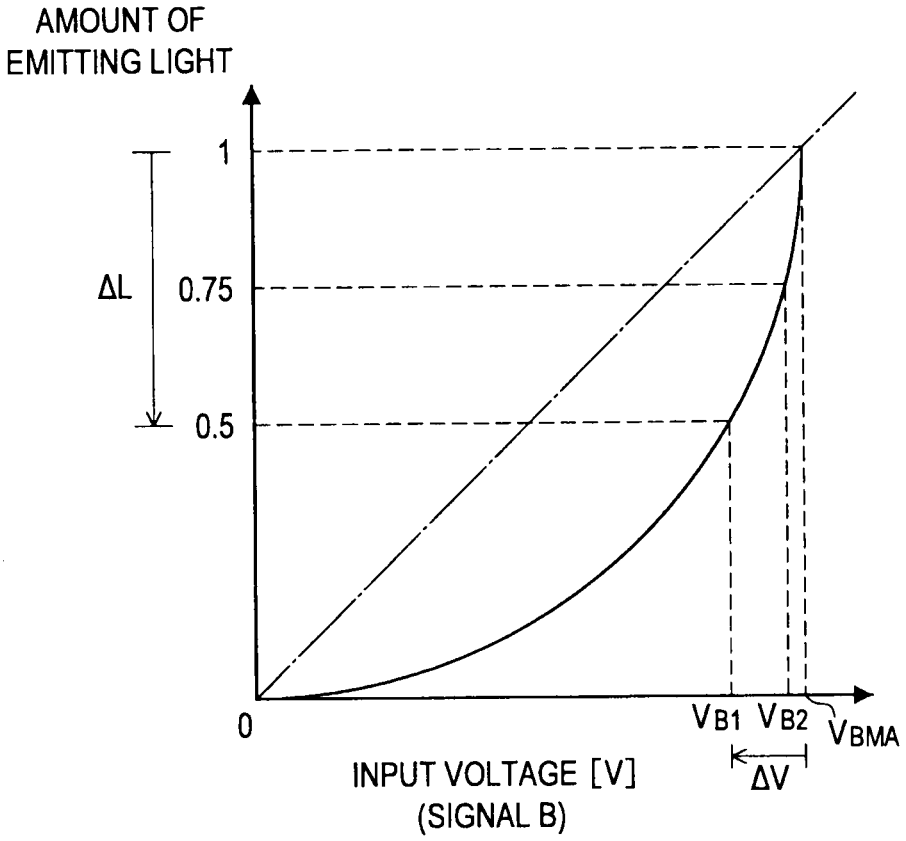
FIG. 5 is a graph showing a relationship between an amount of light emitted from an OLED panel 120 and an input voltage.

The OLED (Organic light-emitting diode) panel 120 is an example of an active matrix drive type self light emitting display panel. For example, the OLED panel 120 has a gamma characteristic as shown in FIG. 5. FIG. 5 is a graph showing a relationship between an amount of light emitted from the OLED panel 120 and an input voltage. The gamma characteristic of the OLED panel 120 is represented by brightness of light (amount of emitting light) emitted from the OLED panel 120 and a panel drive voltage input into the OLED panel 120 from the panel driver 110.

Figure 6:
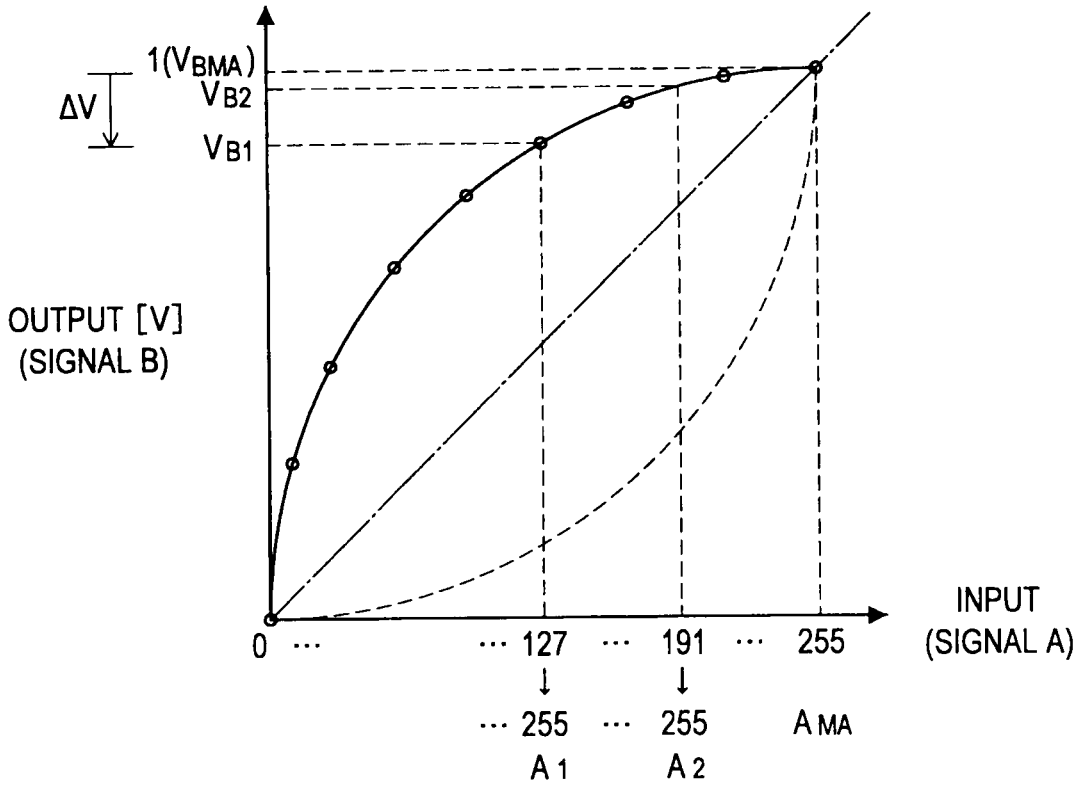
FIG. 6 is a graph showing a relationship between an output signal (signal B) from the panel gamma generation unit 106 and an input signal (signal A) to the panel gamma generation unit 106.

The data having the characteristic opposite to the gamma characteristic of the OLED panel 120 is represented by a curve as shown in FIG. 6. The panel gamma generation unit 106 reads the LUT and performs interpolation processing to generate data having the characteristic opposite to the gamma characteristic of the OLED panel 120 as shown in FIG. 6. FIG. 6 is a graph showing a relationship between an output signal (signal B) from the panel gamma generation unit 106 and an input signal (signal A) to the panel gamma generation unit 106.

The panel gamma generation unit 106 converts the input signal A by using the curve data shown in FIG. 6, and outputs the signal B related to a voltage value. In the embodiment, when a necessary maximum brightness of the light emitted from the OLED panel 120 is changed, the curve data used when the panel gamma generation unit 106 converts the signal is changed according to the necessary maximum brightness. How to change the curve data will be described below.

The amount of data in the look-up table held by the memory 104 can be arbitrarily determined according to a curve characteristic or the like. Specifically, the memory 104 holds data of arbitrary points as represented by the points on the curve in FIG. 6 as table data shown in FIG. 7. FIG. 7 is an explanatory diagram illustrating the look-up table (LUT) of the data having the characteristic opposite to the gamma characteristic of the OLED panel 120. When converting the signal, the panel gamma generation unit 106 interpolates the LUT, so that the panel gamma generation unit 106 can output appropriate value even when a value not included in the table data is input. The interpolation of the LUT is performed by a method used in general, such as linear interpolation.

Figure 8:
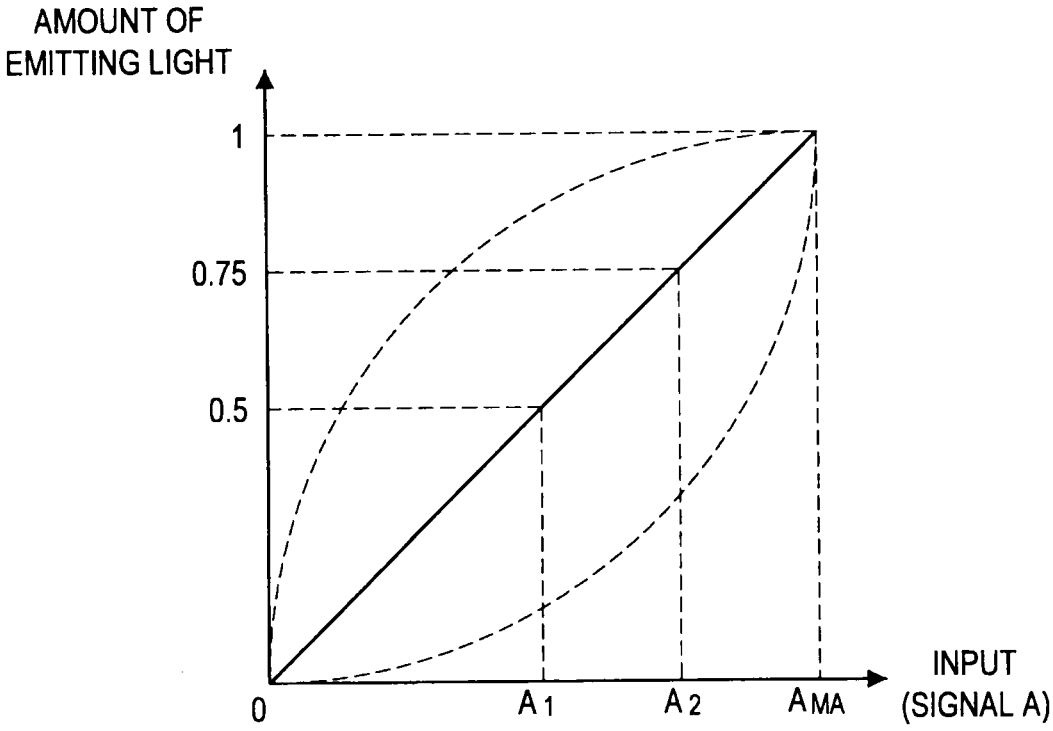
FIG. 8 is a graph showing a relationship between an amount of light emitted from the OLED panel 120 and the signal A.

The signal B output from the panel gamma generation unit 106 is input into the panel driver 110. As a result, the signal A input into the panel gamma generation unit 106 and the brightness of the light (amount of the emitting light) emitted from the OLED panel 120 have a linear relationship as shown in FIG. 8. FIG. 8 is a graph showing the relationship between the amount of light emitted from the OLED panel 120 and the signal A.

The necessary brightness calculation unit 108 calculates a maximum brightness necessary for light emission of the OLED panel 120 to emit light based on a user setting, a detection result of circumference environment, an analysis result of the video signal, and the like. For example, when the organic EL display device 100 can be used as a home display, the brightness of the screen displayed by the organic EL display device 100 is set high according to the home use environment. On the other hand, when the organic EL display device 100 is used as a studio video monitor, a photograph monitor, or the like, in many cases, the organic EL display device 100 is used while the brightness of the video image is kept considerably lower than that of the home use display.

The maximum brightness necessary for light emission of the OLED panel 120 is calculated according to the user setting, the circumference environment, the video signal, and the like. The user setting is performed via a user interface displayed on the screen, an operation unit of the device main body, a remote controller, or the like, and the necessary maximum brightness is calculated according to the setting content. The circumference environment is determined by detecting the strength of the light or the like in an environment where the organic EL display device 100 is installed, and the necessary maximum brightness is calculated according to the circumference environment. The video signal is content data, metadata (program information or the like) accompanying the content data, and the like, and the necessary maximum brightness is calculated based on the data content.

The necessary brightness calculation unit 108 calculates the brightness (the necessary maximum brightness) of the screen displayed by the organic EL display device 100 based on the user setting, the circumference environment, the video signal, and the like. When calculating the necessary maximum brightness, the necessary brightness calculation unit 108 refers to the displayable maximum brightness that can be represented by the organic EL display device 100.

The panel driver 110 outputs a signal for displaying a video image on the OLED panel 120. A D/A converter is included in the panel driver 110, and the D/A converter converts a digital signal into an analog signal, and outputs the analog signal. The panel driver 110 includes a data line driver that provides a data signal $V_{sg}$ to drive a data line, and a scan line driver that drives a scan line. The panel driver 110 further includes a timing generator that provides drive timing to the data line driver and the scan line driver.

In the OLED panel 120, pixels are arranged in a matrix form according to a panel resolution. The OLED panel 120 is, for example, to display a color image, so that the pixels are arranged for each emission color. However, in an organic EL element having a structure in which light emitting layers of a plurality of colors are laminated to form a pixel, one pixel corresponds to a plurality of emission colors.

<2. Operation of First Embodiment>

[How to Change the Necessary Maximum Brightness]

How to change the maximum brightness necessary for light emission of the OLED panel 120 in the organic EL display device 100 according to the embodiment will be described.

As described above, the maximum brightness necessary for light emission of the OLED panel 120 is calculated according to the user setting, the circumference environment, the video signal, and the like. For example, when the organic EL display device 100 can be used as a home display, the brightness of the screen displayed by the organic EL display device 100 is set high according to the home use environment. On the other hand, when the organic EL display device 100 is used as a studio video monitor, a photograph monitor, or the like, in many cases, the organic EL display device 100 is used while the brightness of the screen is kept low. For example, when the displayable maximum brightness that can be represented by the organic EL display device 100 is assumed to be "1", if the brightness may be one-half of the displayable maximum brightness, the necessary maximum brightness is set to "0.5".

When changing the maximum brightness of the screen, a maximum voltage applied to the OLED panel 120 is controlled in the organic EL display device 100 according to the embodiment. For example, as shown in FIG. 5, when the maximum voltage input by the signal B is decreased by $\Delta V$, the maximum amount of emitting light from the OLED panel can be decreased by $\Delta L$. In the example shown in FIG. 5, when the displayable maximum brightness is assumed to be "1", to change the necessary maximum brightness to "0.5", the maximum voltage is decreased to $V_{B1}$, and to change the necessary maximum brightness to "0.75", the maximum voltage is decreased to $V_{B2}$.

In the organic EL display device 100 according to the embodiment, to change the maximum voltage applied by the panel driver 110 to the OLED panel 120, a power supply 130 that supplies a voltage applied to the panel driver 110 is controlled. The maximum voltage value supplied from the power supply 130 to the panel driver 110 is determined by the displayable maximum brightness or the necessary maximum brightness. To change the maximum voltage applied to the OLED panel 120, it is possible to employ a method for changing the maximum voltage applicable from the panel driver 110 by controlling the panel driver 110. In this case, the maximum voltage value applicable from the panel driver 110 to the OLED panel 120 is determined by the displayable maximum brightness or the necessary maximum brightness.

When controlling the maximum voltage applied to the OLED panel 120, an applicable range of the gamma curve used by the panel gamma generation unit 106 which has the characteristic opposite to the gamma characteristic (reverse gamma characteristic) of the OLED panel 120 needs to be changed. This is to maintain the linear relationship as shown in FIG. 8 between the signal A input into the panel gamma generation unit 106 and the brightness of the light (amount of the emitting light) emitted from the OLED panel 120. Hereinafter, the method for changing the applicable range of the gamma curve according to the necessary maximum brightness in the panel gamma generation unit 106 of the organic EL display device 100 according to the embodiment will be described.

For example, when setting the maximum brightness of the screen to the displayable maximum brightness, the gamma curve used in the panel gamma generation unit 106 is used in a range between 0 and $V_{BMA}$ [V] and between 0 and $A_{MA}$ shown in FIG. 6. When the maximum voltage is decreased to $V_{B1}$, the gamma curve used in the panel gamma generation unit 106 is used in a range between 0 and $V_{B1}$ [V] and between 0 and $A_1$ shown in FIG. 6. When the maximum voltage is decreased to $V_{B2}$, the gamma curve used in the panel gamma generation unit 106 is used in a range between 0 and $V_{B2}$ [V] and between 0 and $A_2$ shown in FIG. 6.

Based on this, when the signal A is input into the panel gamma generation unit 106, the signal A and the brightness of the light (amount of the emitting light) emitted from the OLED panel 120 can maintain the linear relationship as shown in FIG. 8.

Further, the input/output values of the gamma curve shown in FIG. 6 are determined by evenly divided according to the number of gradations (color resolution) of the signal A and the signal B. For example, a case in which the color resolution of the signal A and the signal B is 256 gradations will be described. When setting the maximum brightness of the screen to the displayable maximum brightness, the input values are determined by dividing the range between 0 and $A_{MA}$ into 255 values, and the output values are also determined by dividing the range between 0 and $V_{BMA}$ [V] into 255 values corresponding to the input values.

When decreasing the maximum voltage to $V_{B1}$ and setting the necessary maximum brightness to 0.5, the input values are determined by dividing the range between 0 and $A_1$ into 255 values, and the output values are also determined by dividing the range between 0 and $V_{B1}$ [V] into 255 values corresponding to the input values. When decreasing the maximum voltage to $V_{B2}$ and setting the necessary maximum brightness to 0.75, the input values are determined by dividing the range between 0 and $A_2$ into 255 values, and the output values are also determined by dividing the range between 0 and $V_{B2}$ [V] into 255 values corresponding to the input values.

By determining the input/output values as described above, it is possible to change the necessary maximum brightness without changing (decreasing) the color resolution.

The above method for changing the applicable range of the gamma curve according to the necessary maximum brightness will be further described from the view point different from the above description.

Figure 10:
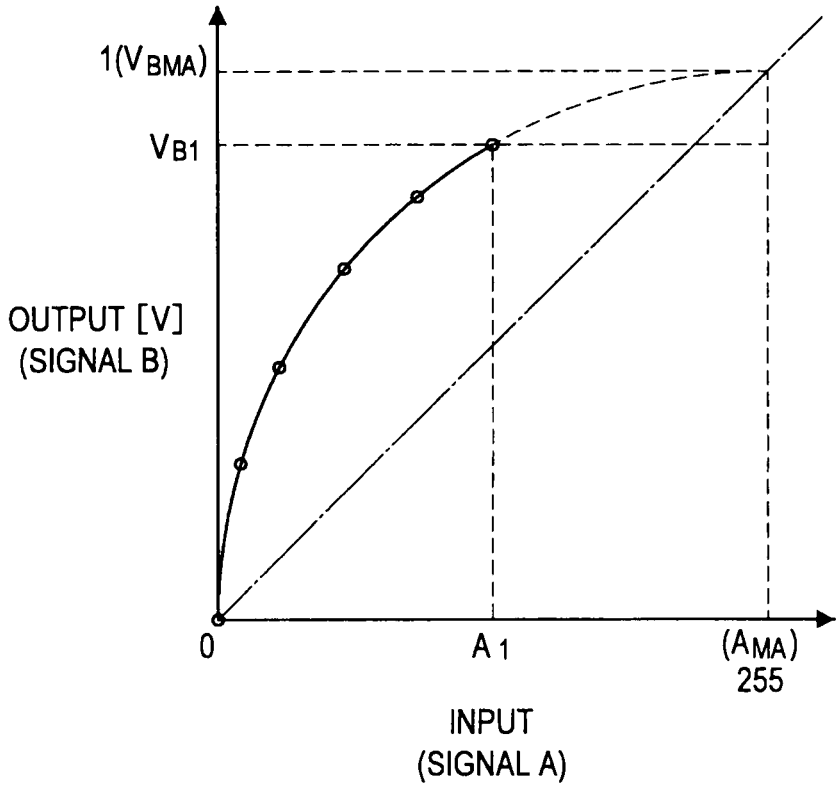
FIG. 10 is a graph showing a relationship between an output signal (signal B) from the panel gamma generation unit 106 and an input signal (signal A) to the panel gamma generation unit 106.

As described above, when the maximum voltage is decreased to $V_{B1}$, the gamma curve used in the panel gamma generation unit 106 is used in the range between 0 and $V_{B1}$ [V] and between 0 and $A_1$ shown in FIG. 6. When the range is extracted and represented by a graph, the range is shown by the solid line in FIG. 10. FIG. 10 is a graph showing a relationship between the output signal (signal B) from the panel gamma generation unit 106 and the input signal (signal A) to the panel gamma generation unit 106.

A LUT which is a source data of the solid line in FIG. 10 is a part of the LUT shown in FIG. 7, and corresponds to a portion of a LUT enclosed by the dashed line shown in FIG. 9A. FIG. 9 is an explanatory diagram illustrating the look-up table (LUT) of the data having the characteristic opposite to the gamma characteristic of the OLED panel 120.

When setting the maximum brightness of the screen to the displayable maximum brightness, in other words, when the gamma curve used in the panel gamma generation unit 106 is used in the range between 0 and $V_{BMA}$ [V] and between 0 and $A_{MA}$ shown in FIG. 6, the input values of the gamma curve are determined by dividing the range between 0 to $A_{MA}$ into 255 values. On the other hand, when the maximum voltage is decreased to $V_{B1}$, the LUT shown in FIG. 9A is converted by using the formula (1) below so that the input value is divided into 255 values in the range between 0 and $A_{MA}$.

$$\text{Input value after conversion} = \text{LUT}(A) \times 255/A_1 \quad (1)$$

Figure 11:
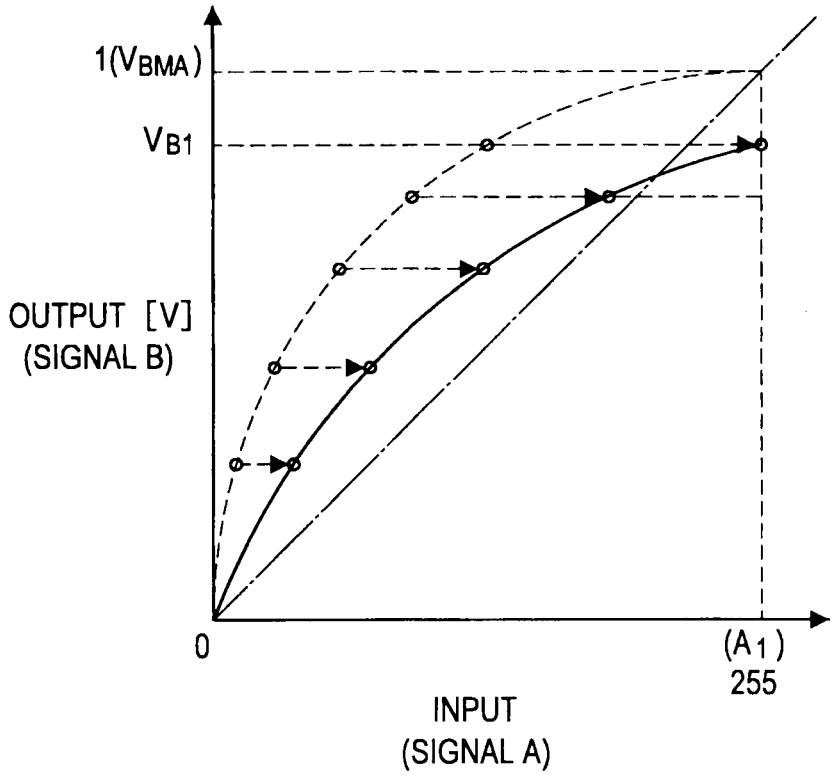
FIG. 11 is a graph showing a relationship between an output signal (signal B) from the panel gamma generation unit 106 and an input signal (signal A) to the panel gamma generation unit 106.

Here, the LUT(A) is an input value included in the LUT in FIG. 9A. The LUT after conversion is shown in FIG. 9(B). A graph corresponding to this is shown in FIG. 11. FIG. 11 is a graph showing a relationship between the output signal (signal B) from the panel gamma generation unit 106 and the input signal (signal A) to the panel gamma generation unit 106.

Further, when representing the output values by values in a range between 0 and 1, the LUT shown in FIG. 9B is converted by using the following formula (2).

$$\text{Output value after conversion} = \text{LUT}(B) \times 1/V_{B1} \quad (2)$$

Figure 12:
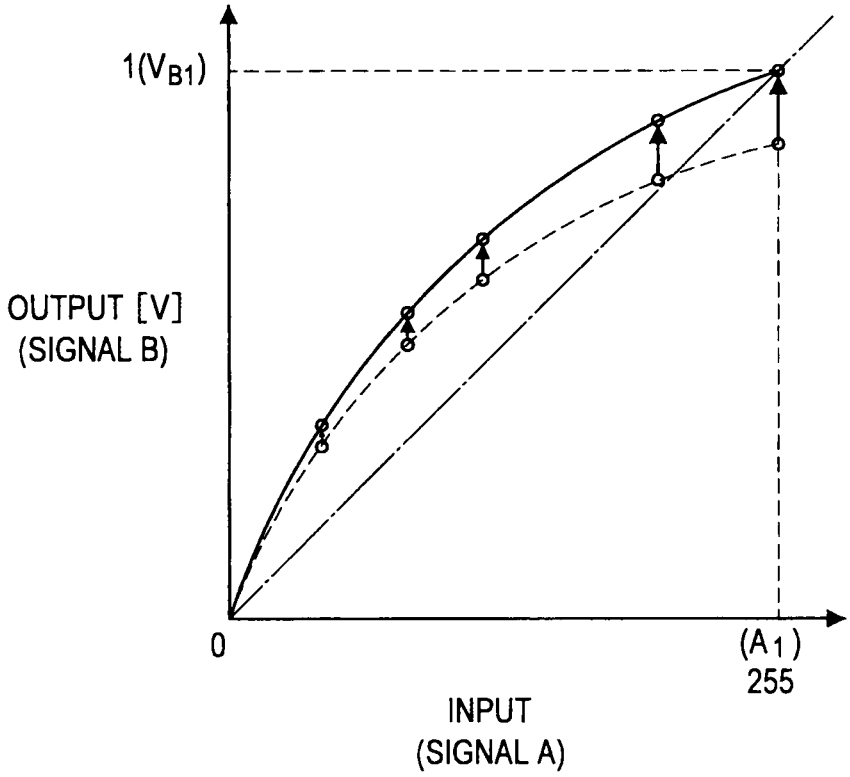
FIG. 12 is a graph showing a relationship between an output signal (signal B) from the panel gamma generation unit 106 and an input signal (signal A) to the panel gamma generation unit 106.

Here, the LUT(B) is an output value included in the LUT in FIG. 9B. The LUT after conversion is shown in FIG. 9(C). A graph corresponding to this is shown in FIG. 12. FIG. 12 is a graph showing a relationship between the output signal (signal B) from the panel gamma generation unit 106 and the input signal (signal A) to the panel gamma generation unit 106.

As described above, by converting the LUT according to the necessary maximum brightness and interpolating the LUT having been converted, it is possible to obtain data as shown in FIG. 12 having the characteristic opposite to the gamma characteristic of the OLED panel 120 corresponding to the necessary maximum brightness. By using the obtained data, the panel gamma generation unit 106 can change the necessary maximum brightness without changing (decreasing) the color resolution, in other words, without the input values being changed.

[Video Image Display Processing]

An operation for video image display processing based on the video input signal in the organic EL display device 100 according to the embodiment will be described with reference to FIG. 1.

First, the necessary brightness calculation unit 108 calculates the brightness (the necessary maximum brightness) of the screen displayed by the organic EL display device 100 based on the user setting, the circumference environment, the video signal, and the like. The maximum voltage applied by the panel driver 110 to the OLED panel 120 is changed according to the necessary maximum brightness by the above method for changing the maximum brightness necessary for light emission of the OLED panel 120. The applicable range of the gamma curve used by the panel gamma generation unit 106 which has the characteristic opposite to the gamma characteristic of the OLED panel 120 is changed according to the necessary maximum brightness.

The video input signal is input into the organic EL display device 100 while the maximum voltage applied to the OLED panel 120 and the gamma curve used in the panel gamma generation unit 106 are changed according to the calculated necessary maximum brightness. When the video input signal is input into the linear gamma generation unit 105, the linear gamma generation unit 105 converts the video input signal to generate the signal A, and outputs the signal A to the panel gamma generation unit 106. The strength of light and the signal A have a linear relationship as shown in FIG. 4.

The panel gamma generation unit 106 converts the signal A to generate the signal B, and outputs the signal B to the panel driver 110. The panel driver 110 applies the panel drive voltage to the OLED panel 120 based on the signal B. The signal A input into the panel gamma generation unit 106 and the brightness of the light (amount of the emitting light) emitted from the OLED panel 120 have a linear relationship as shown in FIG. 8.

As described above, according to the embodiment, while the necessary maximum brightness is decreased lower than the displayable maximum brightness of the OLED panel 120, the color resolution is not changed (decreased). For example, even when the brightness of the screen is changed, the gradation of 256 gradations which can be represented by the organic EL display device 100 can be maintained. In other words, in the embodiment, the brightness can be controlled without decreasing gradation, and further without deteriorating color.

Figure 13:
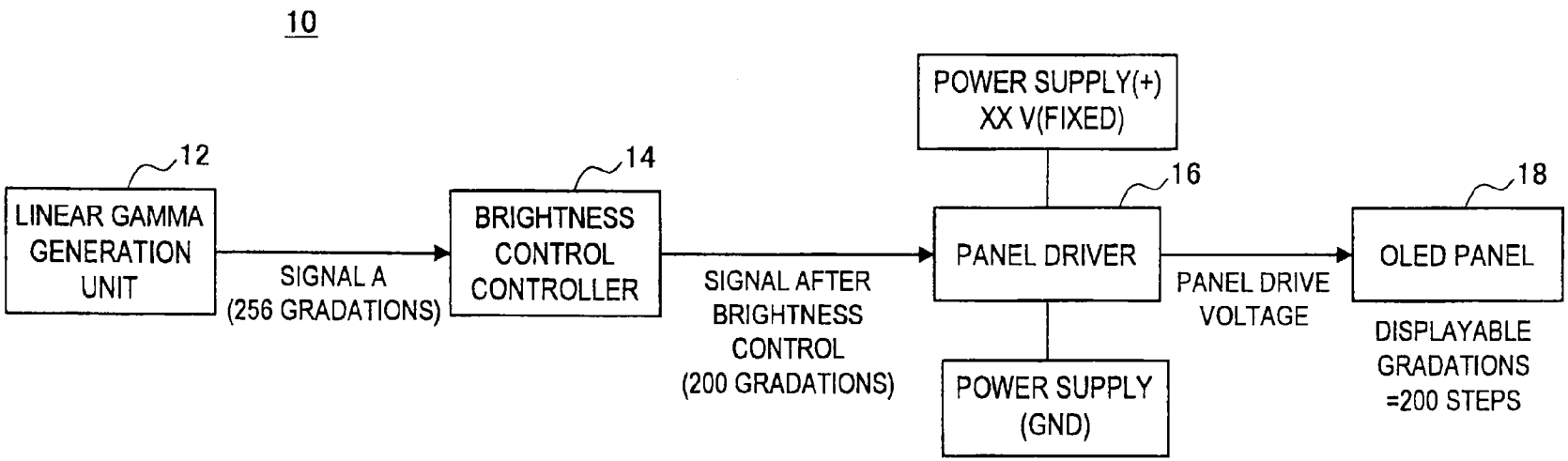
FIG.13 Related Art
FIG. 13 is an explanatory diagram illustrating a configuration and operation of an organic EL display device 10 in related art.

On the other hand, an organic EL display device 10 in related art will be described. As shown in FIG. 13, the organic EL display device 10 in related art includes a linear gamma generation unit 12, a brightness control gain controller 14, a panel driver 16, an OLED panel 18, and the like. The panel driver 16 is connected to a power supply that supplies a voltage of fixed value to the panel driver 16. FIG. 13 is an explanatory diagram illustrating a configuration and operation of the organic EL display device 10 in related art.

In related art, when displaying an image while the brightness of the screen of the organic EL display device 10, which is a self light emitting display, is kept low, the brightness control controller 14 needs to apply a gain to the signal A output from the linear gamma generation unit 12. However, although a signal of 256 gradation is input into the brightness control gain controller 14, for example, a signal of 200 gradation is output.

The panel driver 16 outputs a panel drive voltage to the OLED panel 18. At this time, the gradation which can be represented by the OLED panel 18 of the organic EL display device 10 is 200. In this case, the brightness can be controlled, but an issue arises in gradation expression.

On the other hand, according to the embodiment, various brightness of emitting light can be set according to a usage environment without changing bit depth (resolution) of the video signal. Therefore, in whatever range of the brightness of emitting light, a good image can be reproduced without generating distortion due to a bit error.

It should be understood by those skilled in the art that various modifications, combinations, sub-combinations and alterations may occur depending on design requirements and other factors insofar as they are within the scope of the appended claims or the equivalents thereof.

The present application contains subject matter related to that disclosed in Japanese Priority Patent Application JP 2009-164051 filed in the Japan Patent Office on Jul. 10, 2009, the entire content of which is hereby incorporated by reference.

What is claimed is:

1. A self light emitting display device comprising:

an active matrix drive type self light emitting display panel;

a necessary brightness calculation unit which calculates a necessary maximum brightness to control light emission of the self light emitting display panel based on a user setting, a circumference environment, or a video signal;

a panel driver which drives the self light emitting display panel by changing a maximum voltage supplied to the self light emitting display panel according to the necessary maximum brightness;

a storage unit which holds data related to a reverse gamma characteristic that is opposite to a gamma characteristic between an amount of light emitted from the self light emitting display panel and a voltage supplied from the panel driver to the self light emitting display panel; and a panel gamma generation unit which generates an output signal to the panel driver based on the reverse gamma characteristic by changing a range of the reverse gamma characteristic applied to the video signal according to the necessary maximum brightness while maintaining the same gradations in the reverse gamma characteristic after the range of the reverse gamma characteristic changes as gradations in the reverse gamma characteristic that corresponds to a displayable maximum brightness, wherein the panel driver drives the self light emitting display panel based on the output signal, and the range of the reverse gamma characteristic which is changed according to the necessary maximum brightness is determined based on the maximum voltage.

2. The self light emitting display device according to claim 1, wherein, in the panel gamma generation unit, the number of gradations of a signal corresponding to the range of the reverse gamma characteristic is the same as those when the self light emitting display panel emits light at a displayable maximum brightness regardless of a value of the necessary maximum brightness.

3. The self light emitting display device according to claim 1, wherein the active matrix drive type self light emitting display panel is an OLED panel.

4. The self light emitting display device according to claim 1, the video signal includes metadata and the range of the reverse gamma characteristic is changed according to the meta data.

5. The self light emitting display device according to claim 1, wherein the range of the reverse gamma characteristic is stored in the storage unit as a look up table wherein an input signal voltage is an index to determine a corresponding amount of light.

6. The self light emitting display device according to claim 1, wherein a color resolution of the self light emitting display device remains unchanged.

7. A method for driving a self light emitting display device, the method comprising:

calculating, in a necessary brightness calculation unit, a necessary maximum brightness to control light emission of an active matrix drive type self light emitting display panel based on a user setting, a circumference environment, or a video signal;

driving, by a panel driver, the self light emitting display panel by changing a maximum voltage supplied to the self light emitting display panel according to the necessary maximum brightness;

holding, in a storage unit, data related to a reverse gamma characteristic that is opposite to a gamma characteristic between an amount of light emitted from the self light emitting display panel and a voltage supplied from the panel driver to the self light emitting display panel;

generating, by a panel gamma generation unit, an output signal to the panel driver based on the reverse gamma characteristic by changing a range of the reverse gamma characteristic applied to the video signal according to the necessary maximum brightness while maintaining the same gradations in the reverse gamma characteristic after the range of the reverse gamma characteristic is changed as gradations in the reverse gamma characteristic corresponding a displayable maximum brightness; and driving, by the panel driver, the self light emitting display panel based on the output signal, wherein the range of the reverse gamma characteristic which is changed according to the necessary maximum brightness is determined based on the maximum voltage.

8. The method according to claim 7 wherein the number of gradations of a signal corresponding to the range of the reverse gamma characteristic is the same as those when the self light emitting display panel emits light at a displayable maximum brightness regardless of a value of the necessary maximum brightness.

9. The method according to claim 7, wherein the range of the reverse gamma characteristic is stored in the storage unit as a look up table wherein an input signal voltage is an index to determine a corresponding amount of light.

* * * * *